United States Patent [19]

Quintilian

[11] Patent Number: 4,725,289

[45] Date of Patent: Feb. 16, 1988

[54] HIGH CONVERSION ELECTROSTATIC PRECIPITATOR

[76] Inventor: B. Frank Quintilian, 4259 Sheldon Ave., Baltimore, Md. 21206

[21] Appl. No.: 935,972

[22] Filed: Nov. 28, 1986

[51] Int. Cl.[4] ..... B03C 3/45; B03C 3/09; B03C 3/14

[52] U.S. Cl. ..... 55/2; 55/130; 55/137; 55/149; 55/154

[58] Field of Search ..... 55/2, 128–130, 55/133, 136, 137, 149, 113, 154

[56] References Cited

U.S. PATENT DOCUMENTS

| | | | |
|---|---|---|---|
| 1,345,790 | 7/1920 | Lodge | 55/130 |
| 1,400,795 | 12/1921 | Bradley | 55/130 |
| 1,549,753 | 8/1925 | Edler | 55/130 |
| 2,884,087 | 4/1959 | Matts | 55/130 X |
| 3,985,524 | 10/1976 | Masuda | 55/137 X |

FOREIGN PATENT DOCUMENTS

| | | | |
|---|---|---|---|
| 517067 | 1/1931 | Fed. Rep. of Germany | 55/128 |
| 2435639 | 2/1976 | Fed. Rep. of Germany | 55/128 |
| 40879 | 3/1977 | Japan | 55/137 |
| 33174 | 3/1977 | Japan | 55/136 |
| 790130 | 2/1958 | United Kingdom | 55/113 |
| 629981 | 10/1978 | U.S.S.R. | 55/129 |

*Primary Examiner*—Kathleen J. Prunner
*Attorney, Agent, or Firm*—John F. McClellan, Sr.

[57] ABSTRACT

An electrostatic precipitator with an inlet and outlet duct having corona forming discharge electrodes to ionize the particulate in the gas stream, and multi-lateral stages of collecting zones to collect particulate from the gas stream by impingement and polarity action. The collecting zones are isolated from the flowing gas so the collected particulate can fall away from the gas stream and avoid intermixing with the gas during the normal cycle of operation and during rapping, to minimize particulate re-entrainment. An improved system of balancing the gas stream as it enters the precipitator and during the course of movement through the collecting zones includes flow dividers located between the edges of the collecting electrodes and movable downstream to provide larger flow openings and movable upstream to provide smaller flow openings, thus producing desired flow control. The flow dividers can be set in desired position by making an adjustment at attaching brackets either locally or by remote control through a bell-crank linkage. These features produce uniform flow and gas cleaning through all collecting zones.

14 Claims, 11 Drawing Figures

PRIOR
ART

HIGH CONVERSION ELECTROSTATIC PRECIPITATOR

FIELD OF THE INVENTION

The invention relates generally to material separation and collection and specifically to electro-static precipitators.

BACKGROUND OF THE INVENTION

Inventor's Summation

The following is a summation of the invention by the inventor.

"A commonly used method of separation and collecting particulate matter from the contaminated gases discharged from the stacks of power-plants and other industrial equipment is to direct the gas stream through the precipitator and by exposure to electrical energy to ionize the particulate matter suspended in the gas stream so that it is later attracted to the grounded elements known as collecting electrodes or plates. At certain time intervals the plates are vibrated (rapped) by mechanical means and the collected dust is dislodged and falls into hoppers. Discharge electrodes are also rapped and are suspended in conventional manner.

An undesirable outcome with the conventional collecting plate is that the particulate is mainly collected in the "quiescent zones" near the plate baffles for a short distance downstream. However, charged particles are also attracted to the flat surfaces of the plate between baffles on plates that are parallel with the gas flow. The passage of gases adjacent to these flat surfaces will cause the gas to pick up some of the collected dust on the plate and become recontaminated. This is known as particle re-entrainment and it is to be expected that further gas passage through the precipitator will, little by little, eventually re-collect some of the re-entrainment. This requires careful and meticulous adjustment of rapping intensity and frequencies and cycle timing because excessive rapping can aggravate the problem of re-entrainment.

A further disadvantage of the present parallel flow conventional designs is that the ionized particulate must "migrate" sideways across the flow of gas in which the particulate is suspended in order to reach the surfaces of the grounded collecting plate. The time it takes and the path it follows are influenced by the width of the gas lane and the momentum of the moving particle and the polarity pull from the grounded collecting plate. The resulting path is in the form of a trajectory, because the line of motion of the moving particle in the gas stream and the line of "polarity pull" from the collecting plate are 90° apart. So there is time lapse and distance traveled before the particle is finally attached to the collecting plate. This trajectory distance represents loss of collectibility at each vertical edge of the plate.

Regardless of the many baffle designs in the parallel flow principle, such as triangular, "V" pockets, offset, shielded, etc. they cannot escape the detriment of longer migratory trajectories and in many cases high re-entrainment within the area of flat surfaces of the collecting plates where scrubbing takes place as the gases pick-up collected particulate from the plates when rapping occurs.

My invention provides for high conversion collecting zones that function alternately, for example, first on the right side of a split gas stream and then on the left side of the split gas stream, thus increasing the depth of collection or penetration into the gas stream. Particulate fall-out quiescent zones are also provided of greater volume than on conventional ESP's (electrostatic precipitators).

To quote from a paper delivered to the U.S. Environmental Protection Agency on May, 1980 by Jack McDonald and Alan Dean of the Southern Research Institute, page 22:

"Recent studies have been made to determine the effect of particle re-entrainment on precipitator performance. In studies where the rappers were not employed, real-time measurements of outlet emmisions at some installations showed that significant re-entrainment of mass was occurring due to factors other than rapping. These studies also showed that for high-efficiency full scale precipitators approximately 30–85% of the outlet particulate emissions could be attributed to rapper re-entrainment. The results of these studies show that particle re-entrainment is a significant factor in limiting precipitator performance."

It is with this background that my new "High Conversion Concept" is proposed with the belief that when re-entrainment has been reduced, the ultimate results can be smaller units, less ionization energy and less rapper energy with longer structural life of components, which will all contribute to the conservation of energy.

SUMMARY OF THE INVENTION

The preferred embodiment of my invention employs four stages of electrical energy conversion per row of discharge electrodes. More stages may be used where necessary.

First stage—ionization of particulate (positive+input)

Second stage—collection by impingement (negative—output)

Third stage—collection from one side of split gas stream (negative—output)

Fourth stage—collection from other side of split gas stream (negative—output)

All four stages are condensed to function within each row of discharge electrodes that have similar row spacing to conventional parallel gas flow designs.

In my "High-Conversion" concept the migratory-trajectories are much shorter because the particle momentum and the "polarity pull" act somewhat co-directional, made possible by the closer proximity of the gas stream to the collecting zones provide more space for "fall-out" to drop down and the flowing gases branch off in a diverging direction away from the falling particulate, thereby reducing particle re-entrainment.

This branch-off action is the result of the swaying pattern of gas flow and is similar in shape to single-phase sine-wave curves of alternating current cycles.

The above is not the case with the parallel flow design in which much of the collected particulate on the flat portion of the collecting plate, reacting to the rapper vibrations, must fall against the scrubbing action of the flowing gas, thus causing re-entrainment. Further downstream, the re-entrained material must again be re-collected by the plates and re-rapped off again. This represents a repetition of collection which requires extra electrical energy and collecting space.

Another feature of my "High Conversion" precipitator is that the perforated plate used for gas distribution located upstream in parallel flow units is not needed.

The flow resistance that it produces can be achieved in the present invention by selecting the desired openings by moving the upstream row of slow dividers between the plates closer to the plate edges to desired position, thereby reducing the need for some rappers, space, energy, material and maintenance because the distribution plates must be rapped separately from the collecting plates.

My method of flow balance can be applied also within the collection system to prevent stratification and improve gas exposure to collecting electrode surfaces. My flow dividers can be located at the desired position by adjustment at the attaching brackets or remotely by a lever linkage. Tapered apertures are produced by leaning the top of flow-dividers upstream or downstream.

In a typical parallel-flow unit a 9 foot wide plate may use modules one and one-half feet wide connected edge to edge having fourteen baffles per plate (twelve are effective) and twelve discharge wires (or equivalent) as corona producing elements. This provides one baffle per wire or a ration of 1:1.

In my "High Conversion" concept there is a ratio of three baffles or collecting zones per wire or 3:1. Assuming a prediction error of one-third, then the ratio becomes 2:1, giving my "High Conversion" unit two times greater collectibility than conventional parallel flow design. An example is shown as to how this ratio can be used in practice. Assume a conventional precipitator with collecting plates nine feet wide by forty feet long, making the collecting core size 2268 cubic feet in volume, using nine plates totaling 6.3 feet with discharge wires interspersed in the middle of the lanes. To produce an equivalent "High Conversion" unit for the same output and conditions, the following formula will apply.

Plate Height = Collection Core Volume Divided By Plan Area — (width × breadth)

$$\text{Plate Height} = \frac{1134}{8.4 \times 5} \text{ (Half volume of parallel flow)} = 27 \text{ feet}$$

Conventional ($6.3 \times 9 \times 40 = 2268$) vs ($8.4 \times 5 \times 27 = 1134$) High Conversion The aspect ratio of the gas entering duct of the conventional ESP is 6.3 feet×40 feet or 6.4 to 1.

In the "High Conversion" unit the aspect ratio is 8.4×27 or 3.2 to 1. This allows for better gas entering conditions and will not require guiding vanes to have desirable gas dispersion.

The value of my "High Conversion" concept is based on the premise that when it becomes known that certain components are found to be detrimental to the efficiency of existing designs, then the units are obviously in need of redesign and it is incumbent upon conservation minded innovators to use other principles of apparently higher integrity to update designs that have been in existence for 50 years more or less, particularly that have been in existence for 50 years more or less, particularly if the following objects can be attained by doing so, such as: size-reduction and sectionalization by eliminating components that contribute measureably to particle re-entrainment and eliminating unnecessary space and hardware and by reducing field erection time.

Increased efficiency by providing more collecting zones in a protected atmosphere per unit of gas travel distance and reducing migratory trajectories that use up time and distance, thus increasing the collectibility quotient or (c.q).

Collectibility quotient is the ratio of the amount of collected equivalent material per units of gas velocity, temperature, exposure time, corona density and housing size.

Cost reduction-predicted performance of this invention vs conventional parallel flow is 2 to 1.

Conservation of energy and health. Lower cost of acquisition and maintenance of pollution control equipment should encourage those industries where pollution is produced to use more of such devices as they become more economical.

The demands for pollution control from society are expected to also increase as they learn more of the ravaging effects of pollution on the environment and on the general health of the community.

Among the objects of the invention are that of providing an ESP that has one-half the size of a conventional unit with equivalent output based on the following extrapolation.

Extensive tests have shown that for high-efficiency full scale precipitators, approximately 30% to 85% of the outlet particulate emissions could be attributed to rapper reentrainment, by applying all of the refinements of my invention, it is estimated that relative to conventional ESP's the average of 50% of the total outlet emissions which now occur during rapping can be reduced to an insignificant point. The size of my embodiment when reduced to 50% of that of the conventional ESP would provide performance equivalent to the conventional ESP (the same output). Such reduction of size is conducive to sectionalization which permits the transportation of many sub-assemblies that have been shop fabricated and tested, reducing the amount of field erection that is time consuming and costly.

In my embodiment the inlet and outlet duct size generally have an aspect ratio closer to unity than conventional units; this improves flow conditions and in many cases flow directional vanes are not required, avoiding undesirable flow resistance and extra hardward and maintenance.

Yet a further object is to provide an improved system of adjustably balancing the gas stream as it enters the precipitator and during passage through the collection system of the precipitator.

OBJECT OF THE INVENTION

To provide a mechanism for flow control that will optimize the gas distribution and aerodynamic balance in electrostatic precipitators. The operation can be done manually or may be automatic by servo control in response to signals from external instrumentation for continuous correction during operation of the precipitator.

FLOW AND COLLECTION CHARACTERISTICS

The gas to be treated is directed into the precipitator housing by an inlet duct not shown. The first row of positive discharge electrodes ionizes the particles in the gas stream so that collection by impingement can take place as soon as the gas comes in contact with the collecting system. The gas will separate out into a multitude of smaller streams of narrow width and as high as the collecting plates. The constricted width is narrower than all subsequent openings because the flow dividers are positioned closer to adjacent plates than in all subsequent openings. This is done to produce sufficient back-pressure at this point to bring together the gas into uniform streams and break up any stratification in the main stream so that the smaller gas stream passing through the collection system can be uniform and receive optimum exposure to the collecting electrodes.

As the gas continues downstream, eddies in the currents are formed on the downstream side of the first row of collecting plates and flow dividers, which cause "quiescent" collecting zones starting at each edge of the collecting plates and flow-dividers (both are grounded). The expanding gas caused by the unbounded atmosphere between rows of plates, reduces its internal pressure and it widens out to form large low pressure zones between adjacent streams where ionized particles are attracted to grounded collecting electrodes. The diverging low velocity stream of gas separates from the collected mass of particulate and continues to the next row of collecting electrodes. The large low pressure "quiescent" zones provide ample space for the particulate to "free-fall" well away from the gas stream to avoid re-entrainment when rapping occurs. Any stray particles from the impingement collecting zones will roll around the edges of plates and flow-dividers directly into the eddy current collecting zones and avoid reentrainment. These phenomena take place at every subsequent row of collectors until the clean gas leaves the collecting system.

Further, a commonly used method of producing gas flow distribution and balance in a conventional electrostatic precipitator is to direct the gas through a fixed perforated plate having a plurality of fixed apertures with a combined flow area to produce the required back-pressure.

However, as noted, there are many influencing factors that may affect performance, such as variations in temperature, flow, particulate density and concentration, humidity, rappers and these conditions may require a re-direction of gas flow through the precipitator occasionally to compensate for these adverse effects on performance. Indicators can be used to signal flow control corrections so that optimum gas cleanliness can be maintained.

With the use of the remote control flow dividers of this invention the control of the gas flow can be infinitely adjustable between limits and provides three main features.

(a) Gas flow aperture areas can be selected for optimum flow control at the job-site. An aperture may be varied with parallel sides, tapered to wider at top and tapered to wider at bottom. Flow resistance can be varied during operation.

(b) In addition to the first upstream row of adjustable flow dividers other rows may be so equipped, located strategically elsewhere in the precipitator as conditions warrant.

(c) Application of external sources of excitation to the flow control linkage system to reduce starting friction from a position of rest so that actuating forces can be minimized.

A logical method of application for the adjustable flow dividers is as following:

(a) Attach upstream row and other row or rows of flow dividers, with manual remote control and linkage mechanism, provided and used as shown in FIGS. 5–9. The remaining flow dividers are mounted in fixed position.

(b) Add the necessary equipment as an option, at any time after installation if needed for automatically correcting unpredictable disturbing influences.

BRIEF DESCRIPTION OF THE DRAWINGS

The above and other objects and advantages of the invention will become more readily understood from examination of the drawings in which like reference characters refer to like parts.

DETAILED DESCRIPTION OLD ART

Figure 1:
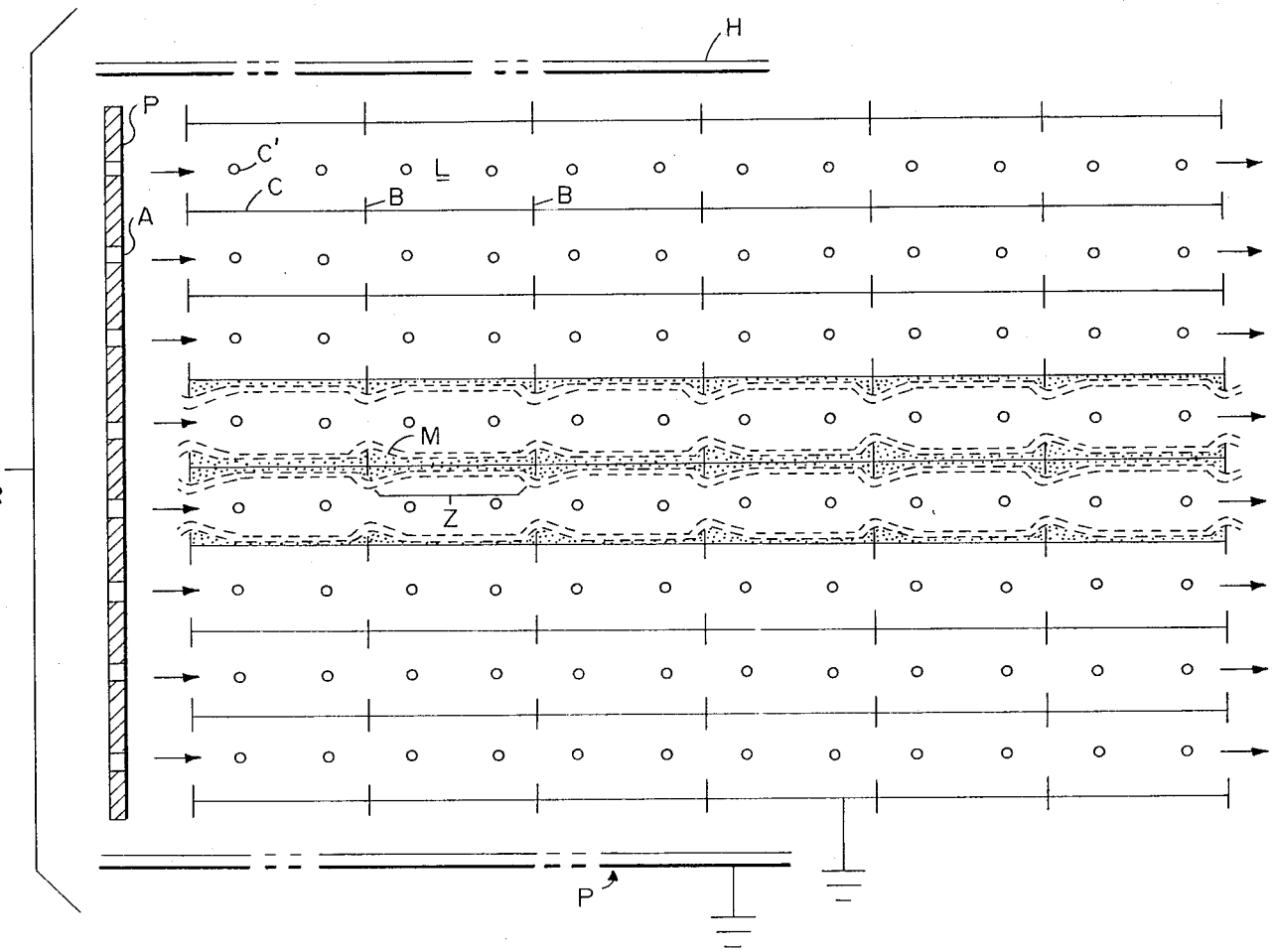
FIG. 1 is a sectional plan diagram of an old art apparatus.

FIG. 1 shows details of a representative old art electrostatic precipitator P. Flow is generally parallel, with flow direction indicated by the arrows.

At the upstream end a typical perforate plate P is disposed. The grid of apertures A is necessary to distribute the flow. Without it the gases tend to flow unevenly, to one area or another and the particulate matter precipitated to collect unevenly.

Downstream from the perforate plate, and generally parallel with each other and with the direction of gas flow, a plurality of hanging plates or negative collecting electrodes C with negative polarity divide the interior of the housing, fragment shown at H, into parallel lanes L.

Each collecting electrode C has equally spaced along the length thereof, a plurality of transverse baffles B extending the full height of the collecting electrodes.

Within each lane is series of hanging positive electrodes C' that may be wires or barbed wires or other elongate structures with corona discharge tips or points therealong. These are disposed in rows along the middle of the lanes.

After the gas passes through the perforate plates it enters the lanes and is ionized by the discharge or positive electrodes C'. The charged particulate is then attracted to the negative collecting electrodes or plate C and travels in a migratory trajectory after the ionization takes place.

The migratory trajectory is a result of the combination of "polarity pull" and the velocity of the particles in the flowing gas stream. At a predetermined time, the particulate is removed from the collecting electrodes or plate C by conventional rappers or vibrators (not shown) and then falls down into hoppers or conveyors below.

As mentioned above, the particulate matter M is attracted and collected mainly on the downstream side of the baffles.

The flowing gas is in conjugate action with the dust or precipitate so that when the plates are rapped the dust must fall in a confined space as at each baffle, and feathers-out on the plate flats or fallout zones Z between baffles.

The close proximity of the gas stream to these flats causes significant re-entrainment of the particulate in the gas streams.

This is significantly avoided by the present invention.

Figure 1A:
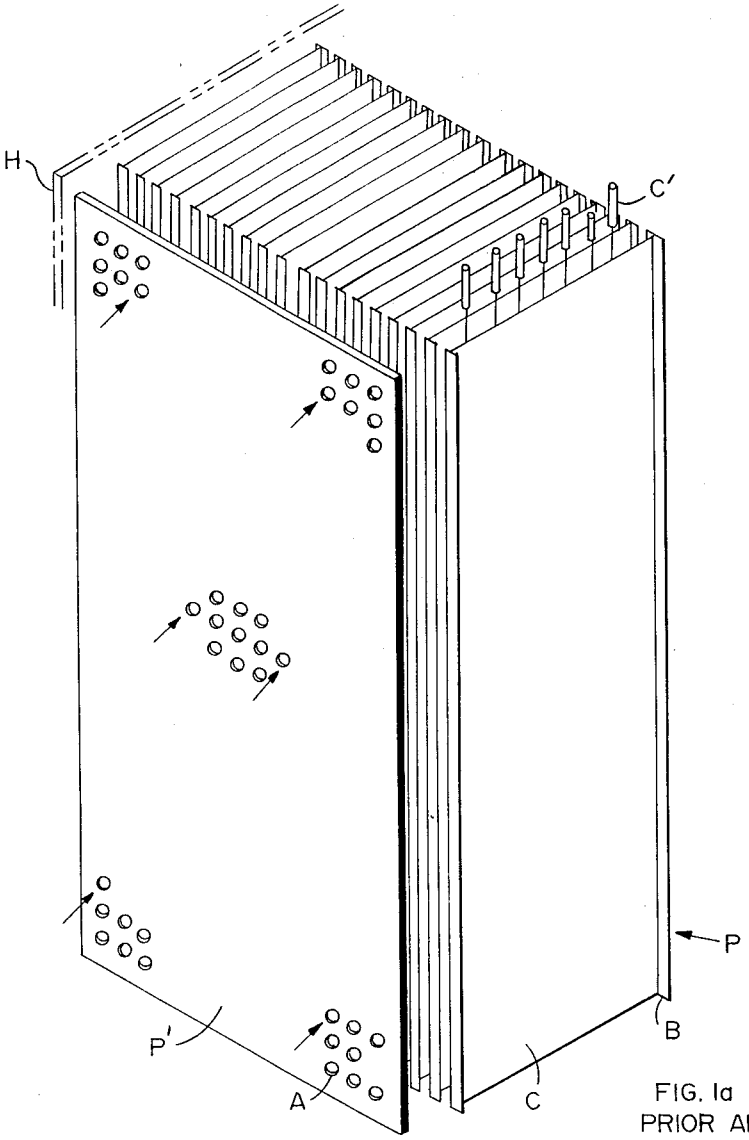
FIG. 1a PRIOR ART
FIG. 1A is a perspective view of the old art apparatus.

FIG. 1A is a perspective diagram of an old art device P of the type, indicating typical distributor plate P' with some of the conventional grid of apertures A, collecting plates C, baffles B and one row of the positive electrodes C' and housing H.

DETAILED DESCRIPTION OF THE INVENTION

Figure 2:
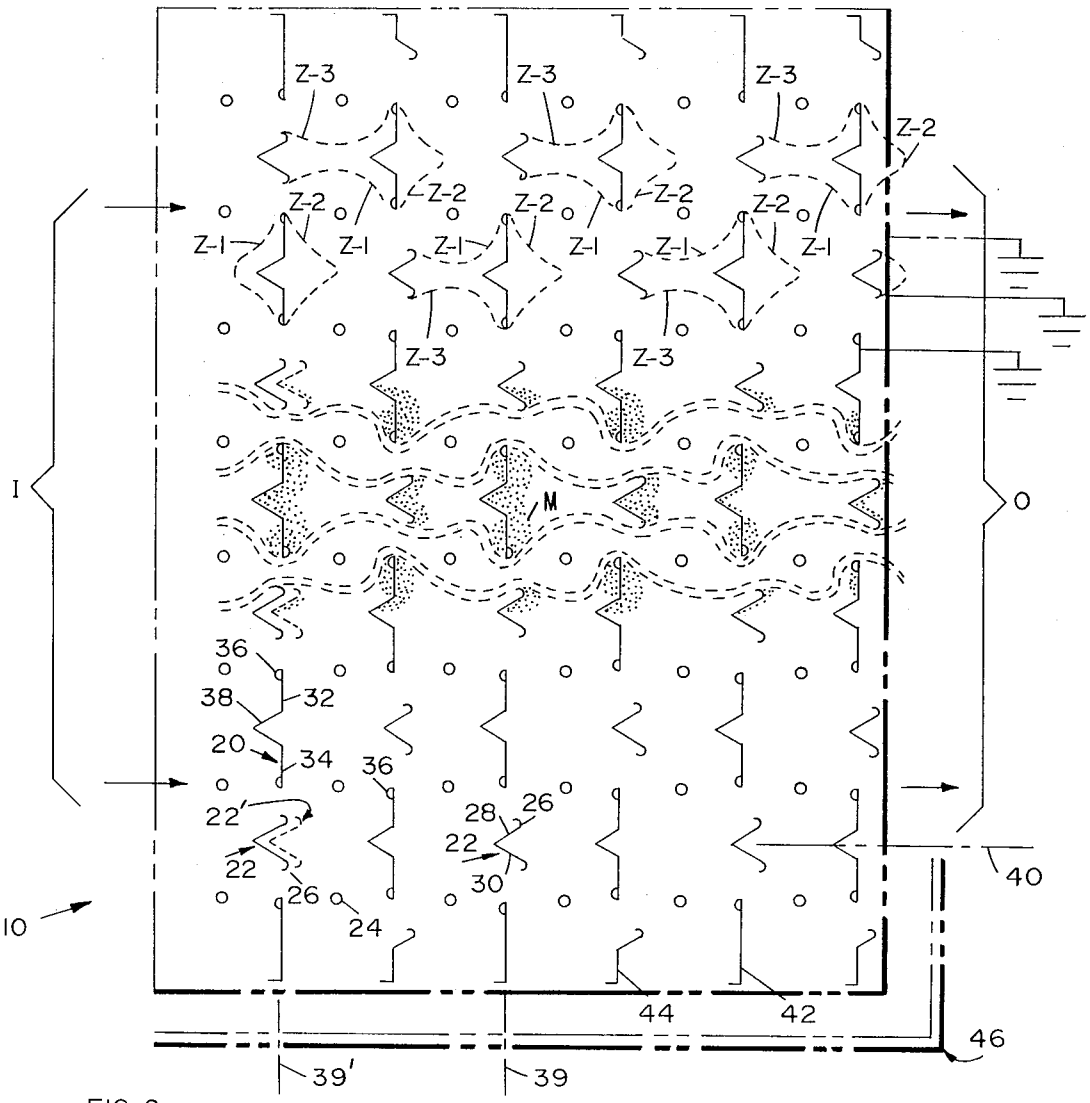
FIG. 2 is a sectional plan diagram of a first embodiment of my present invention.

FIG. 2 shows in sectional plan diagrams a first embodiment 10 of the invention. The figure depicts an area of the invention on a scale similar to that of FIG. 1, a plurality of first hanging negative electrodes or plates 20, and second hanging negative electrodes 22, interspersed with a plurality of hanging positive electrodes 24. Gas flows from left to right (arrows). Housing 46 is provided with inlet "I" and outlet "O" openings.

The plates 20, 22 are disposed in a regular staggered grid array and the positive electrodes 24 are interspersed with the plates in a regular pattern.

In the old art illustrated the lanes and fallout zones are formed by continuous steel walls with periodic restrictions or baffles. In the present invention, the lanes and fallout zones are well defined but are formed by the periodic restrictions or baffles, the hanging negative electrodes 20, 22 without the walls. This provides the larger fallout areas described, as at Z-1, Z-2, Z-3, for collection of the particulate matter M. Further, it substantially eliminates the re-entrainment flats between the baffles and provides the three types of deposit mechanisms described.

The greater volume of the fallout zones is the result of a space created by two spaced-apart gas streams. The gas stream departs from the collected dust in a diverging direction.

Two types of negative plates are provided. The first type 20 acts as the main collecting negative electrode. The outboard or lateral end of each leg 32, 34 is formed in a rounded or cylindrical shape 36 to prevent arcing.

The element 20 is symmetrical about a trough-shaped central portion 38 or prow-like protrusion that extends upstream.

The second type negative plate 22 acts as a flow divider.

This is a vertically elongate symmetrical "V"-section member, convex against the gas flow, and with an outward semi-cylindrical curl 26 terminating each of the legs 28, 30 of the "V". Th curl prevents spark-over or arcing.

The positive discharge electrodes 24, may be as in the old art, wires, or may be barbed wires or other elongated structure with corona discharge tips therealong to produce a corona to ionize the particulate.

The plates 20 and 22 are alternated in rows 39 perpendicular to the gas flow and in rows 40 parallel with the gas flow.

The plates 20, 22 are generally uniformly arranged in each row, 39, 40 except that in the first row 39' across the gas stream the plates 22 may have brackets of chosen length to offset them in the downstream direction as at 22' in order to distribute the gas more evenly in the downstream collecting zones.

At the margins of the assembly, special terminal plates 42, 44 may be positioned so as to block off undue flow, but must not touch the housing 46.

Figure 2A:
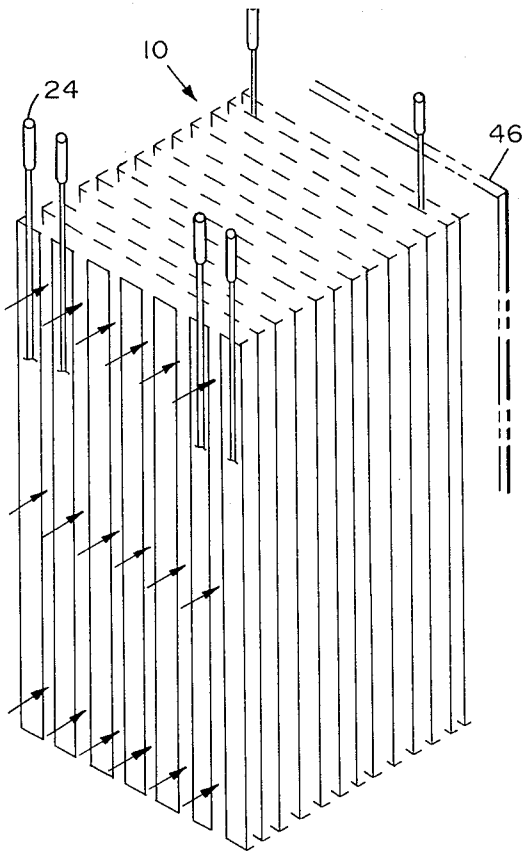
FIG. 2A is a perspective view of my first embodiment.

FIG. 2A is a perspective of the first embodiment 10 of this invention, and shows a volume comparison of comparable capacities with the old art represented by FIG. 1A. The housing is represented by broken lines at 46. Representative hanging positive electrodes appar at 24. The hanging positive electrodes 24 are suspended from a common beam which, in turn, is suspended from a housing roof with dielectric separators.

The "rapper" will be connected to the common beam with a dielectric post, all in accordance with conventional practice.

Figure 3:
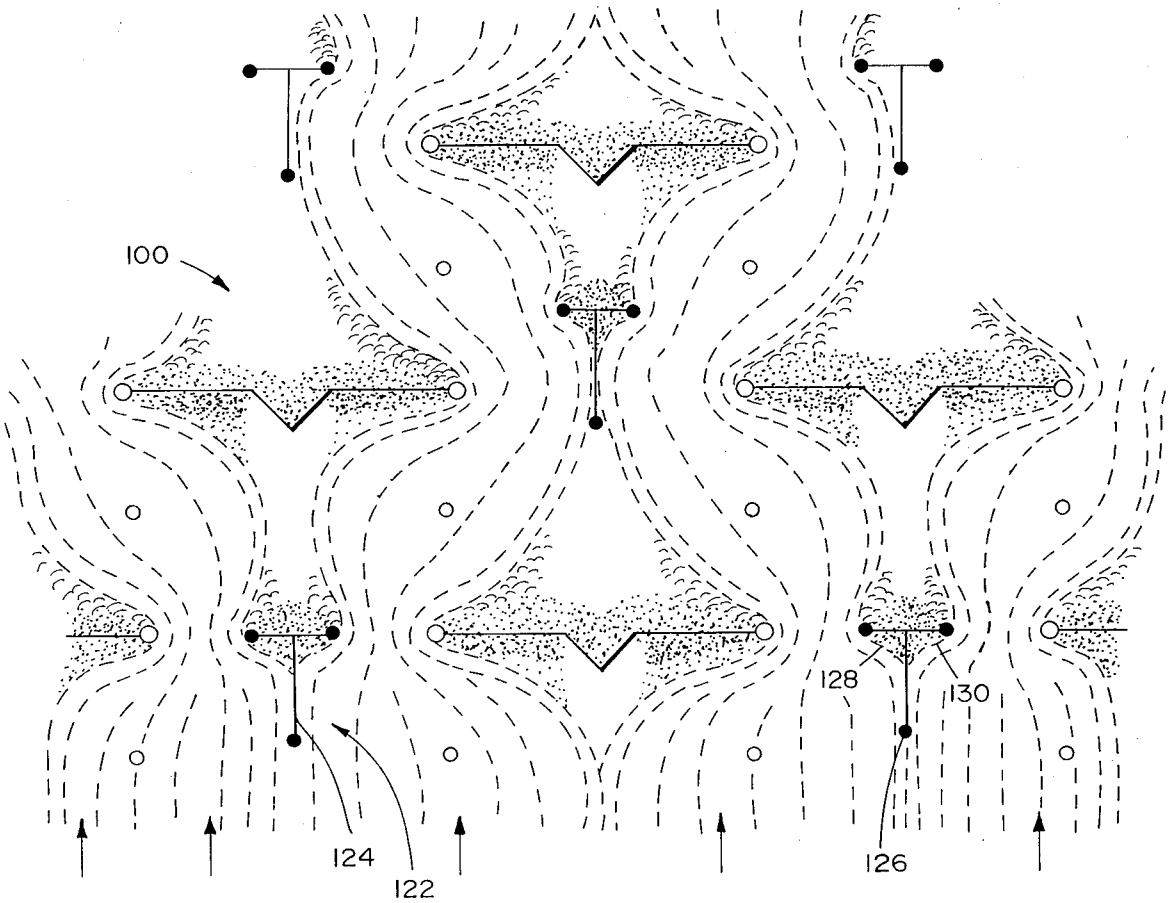
FIG. 3 is an enlarged fragmentary sectional plan detail of my second, preferred embodiment.

FIG. 3 is an enlarged plan detail of a fragment of the preferred embodiment 100.

This embodiment 100 may be the same as the embodiment 10, except that the flow dividers 122 are "T"-shaped in section, with the stem 124 of the "T" extending upstream. The main advantage is to afford a greater flow opening at the constricted areas of flow than the flow dividers previously described, and to provide additional impingement area as at 128, 130. The extremities are rounded as at 126 to prevent arcing.

Figure 4:
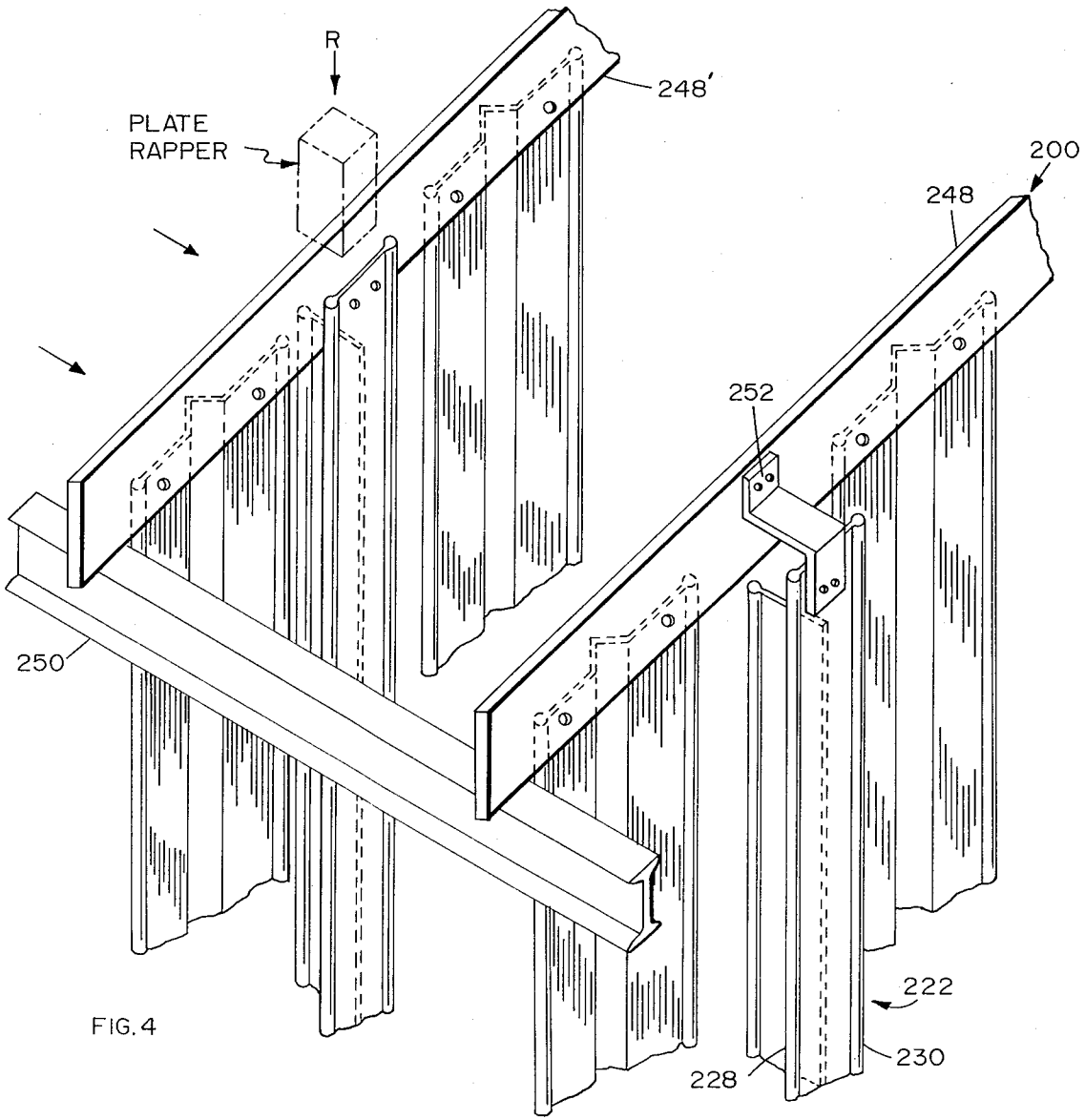
FIG. 4 is a further enlarged fragmentary sectional plan detail of my second embodiment.

FIG. 4 shows a perspective assembly detail of the preferred embodiment 200. Any suitable conventional rapper shows at "R".

The legs 228, 230 of the flow dividers 222 may be, in the first row transverse to gas flow (arrow), fixed to the transverse supporting beams 248, 248' which are, in turn, supported by the main structural beams 250. In the other rows they may be supported slightly downstream by brackets 252.

Figures 5, 6:
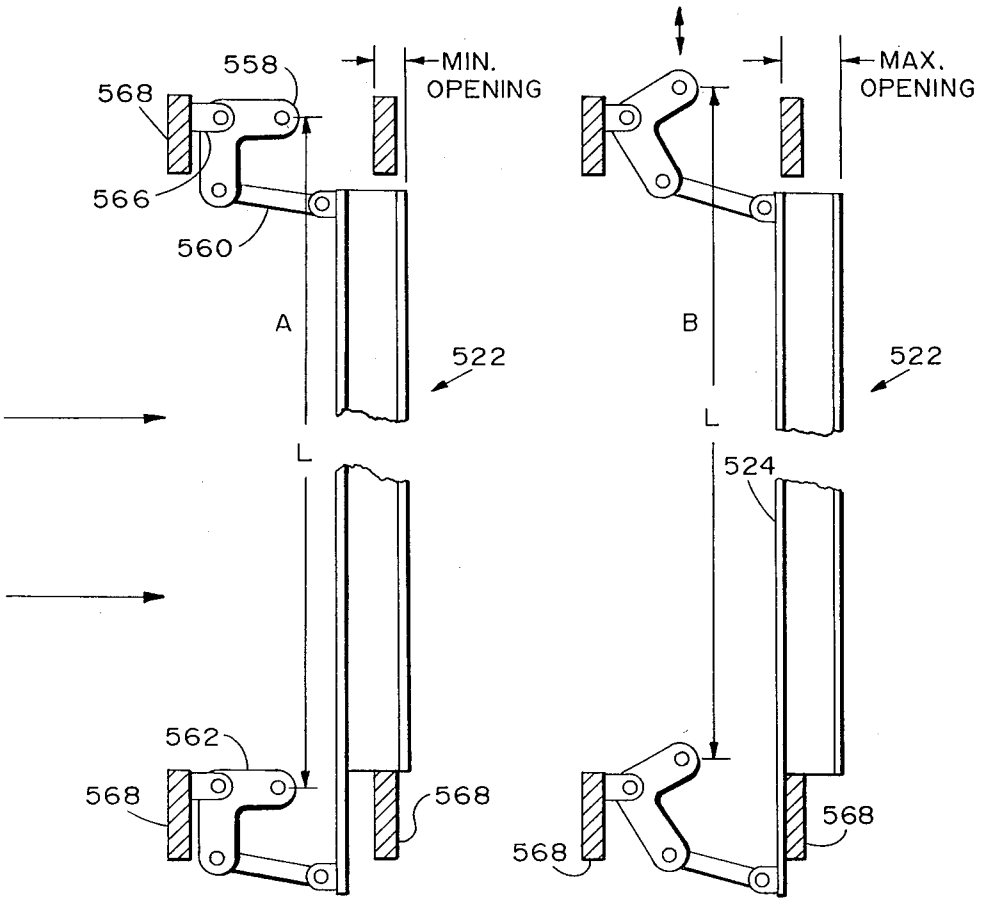
FIG. 5 is a side elevational partly sectional view of an embodiment with linkage shown at minimum flow position.
FIG. 6 is a similar view with linkage shown at maximum flow position.
Figure 7:
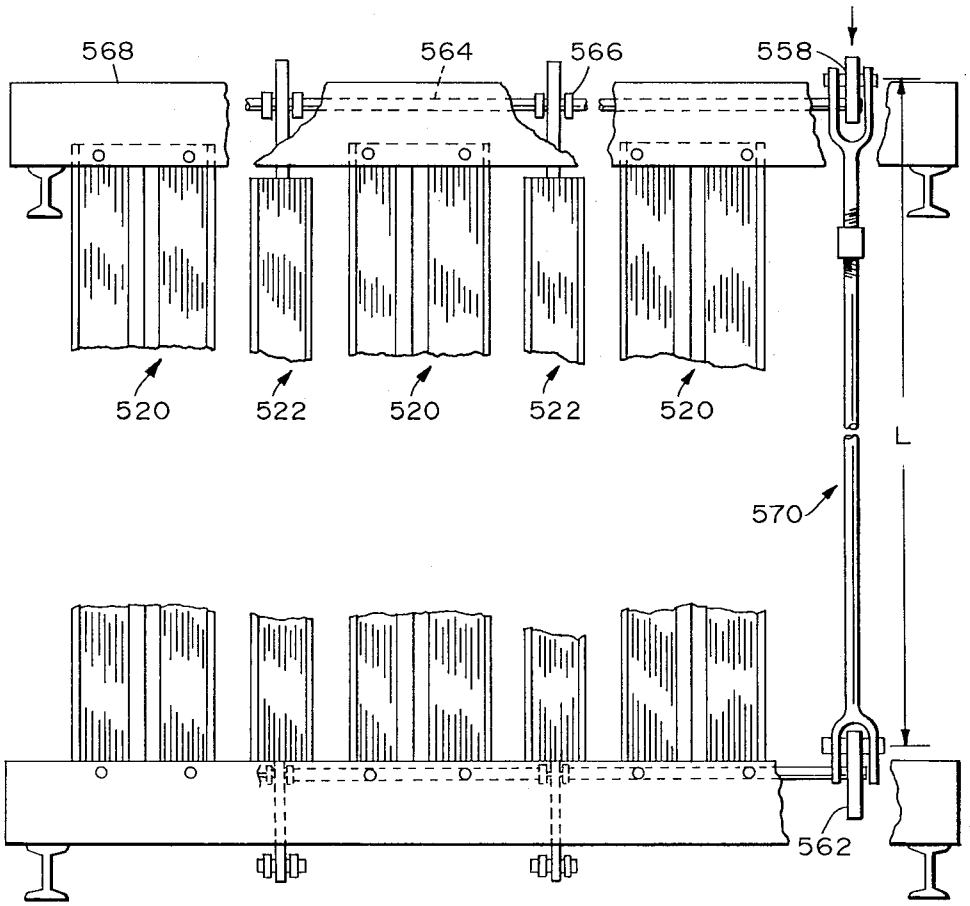
FIG. 7 is a front elevational view thereof showing a plurality of flow dividers and collecting electrodes with traversing and tilt linkage.

FIGS. 5, 6 and 7 show a flow-divider 522 (like that of FIG. 4 at 222). FIGS. 5 and 7 show minimum flow position established by position of top bell-crank 558, intermediate links 560 and bottom bell crank 562. The bell cranks are actuated by traversing rod 564 (FIG. 7) and are held in pivoting position by brackets 566 attached to supporting beam 568. The minimum position "A" provides minimum flow opening laterally between the flow divider 522 (arrow) and the adjacent collecting plates 520. Flow divider 522 rests on beam 568 and slides back and forth on it as the aperture is adjusted. Numeral 524 corresponds to 124, FIG. 3 showing the stem of the "T".

FIG. 6 shows flow divider 522 slid on beam 568 to the maximum open position "B". As noted, the relative positions of the top and bottom bell-cranks are maintained by the turnbuckle rod 570 so that both bell-cranks can move in unison, resulting in parallel movement of flow-dividers between minimum and maximum positions.

Figure 8:
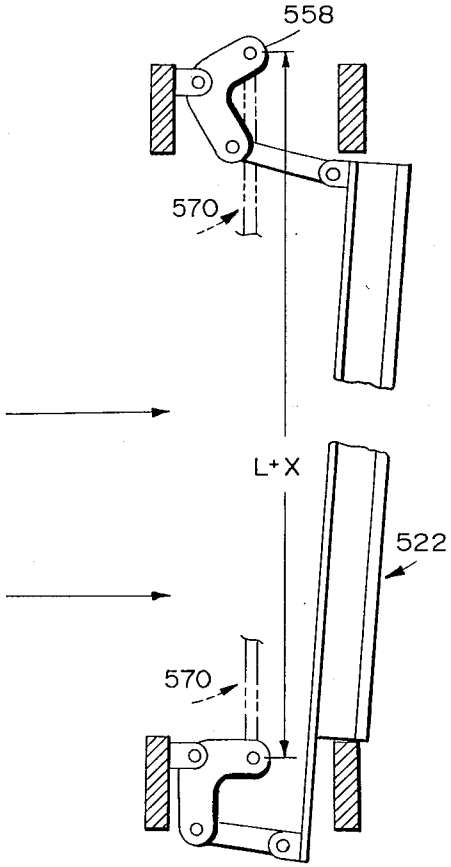
FIG. 8 is a side elevational showing of a turnbuckle adjustment for downstream tilting of a flow divider for top trimming of flow.

FIG. 8 shows an advantageous feature, tip adjustment of the flow dividers 522. It is a side elevation showing the turnbuckle connecting rod 570 adjusted to an increase in length from "L" to "L+x" rotating top bell-crank 558 and causing the top of the flow divider to tilt downstream to produce a tapered flow aperture opening to balance flow characteristics when needed. Further, actuation of the top bell-crank will then cause flow divider 522 to move back and forth in a parallel relationship to the inclined position.

Figure 9:
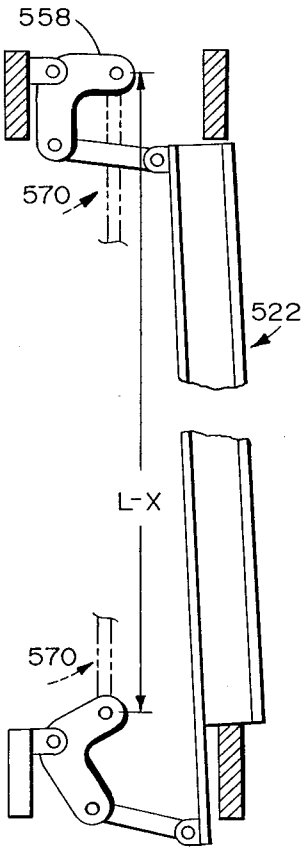
FIG. 9 is a side elevational showing of a turnbuckle adjustment for upstream tilting of a flow divider for bottom trimming of flow.

FIG. 9 shows the turnbuckle connecting rod 570 adjusted to a decrease in length from "L" to "L-x" causing the top of the flow divider to tilt upstream to produce a tapered flow aperture opening opposite to that in FIG. 8. Again as in FIG. 8, continued actuation of top bell-crank 558 will move the flow divider back and forth in parallel relationship of the reverse angular setting.

In any of the described positions of flow dividers actuation of the top bell-crank for opening variation may be achieved by manual means or servo means when automatic adjustment is desired to maintain continuous response from control instrumentation during operation of the precipitator for optimum performance.

Expressions such as "semi-cylinder" are for exposition only; any suitable equivalent rounded structure will serve the purpose as well.

This invention is not to be construed as limited to the particular forms disclosed herein, since there are to be regarded as illustrative rather than restrictive. It is, therefore, to be understood that the invention may be practiced within the scope of the claims otherwise than as specifically described.

What is claimed and desired to protected by United States Letters Patent is:

1. A system for electrostatic precipitator deposition of material from a stream of gas flowing in a direction from upstream to downstream in a housing, comprising: means for producing a swaying deposition path of said stream of gas, including a plurality of rows of alternately first and second negative electrodes, said first and second negative electrodes and said rows being transverse to said flow direction and defining respective spacings between said first and second negative electrodes, the first and second negative electrodes having first and second edges respectively and in each row being staggered with respect to the first and second negative electrodes of next adjacent rows upstream and downstream from it, a plurality of positive electrodes in rectangular-grid disposition, each positive electrode being located in-line between a first edge of a first negative electrode and a second edge of a first negative electrode adjacently downstream from the first edge of the first negative electrode, thereby producing said swaying deposition path.

2. A system as recited in claim 1, wherein each of the first and the second negative electrodes comprises an elongate member with a respective width, and wherein said width of the first negative electrodes is substantially greater than the width of the second negative electrodes.

3. A system as recited in claim 2, wherein each of the first negative electrodes has a prow-like protrusion symmetrical to the width thereof and extending upstream and having on either side thereof flat portions terminating in said first and second edges, and said first and second edges being rounded.

4. A system as recited in claim 3, wherein each of said second negative electrodes has a body shaped like a "V", with the apex of the "V" facing upstream and with first and second edges curved in said upstream direction.

5. A system as recited in claim 4, wherein means is provided for adjusting flow of gas through said spacings, comprising means for adjusting in upstream/-downstream direction the location of a plurality of said second negative electrodes.

6. A system as recited in claim 4, wherein means is provided for adjusting flow of gas through said spacings, comprising means for adjusting the angular disposition in upstream/downstream direction of a plurality of said second negative electrodes.

7. A system as recited in claim 2, wherein each of the first negative electrodes has a prow-like protrusion in the form of a plate protruding in an upstream direction centrally therefrom, and wherein said prow-like protrusion has a rounded edge in said upstream direction.

8. In an electrostatic precipitator system for collecting suspended matter from a primary flowing gas stream comprising a housing with inlet and outlet openings, a plurality of discharge electrodes for ionizing suspended matter, a plurality of collecting electrodes with rounded edges for resisting arcing and re-enforced by respective central trough-shaped depressions, said plurality of collecting electrodes located at said housing in parallel row arrangement with gas stream flow spaces between them forming a plurality of collection zones, said collecting electrodes including first negative electrodes and second negative electrodes, the second negative electrodes comprising a plurality of flow dividers, each said row having a plurality of said flow dividers in the respective flow spaces, said flow dividers and first negative electrodes being staggered in each row relative to adjacent rows, thereby breaking up said primary flowing gas stream into a plurality of smaller gas streams, said plurality of smaller gas streams being directed to flow in a swaying manner and always in downstream direction, alternately contracting and expanding and forming hour-glass patterns in combination with adjoining said smaller gas streams of said plurality.

9. A system as recited in claim 8, wherein is provided a first plurality of corona discharge electrodes spaced upstream of said collecting electrodes, and a second plurality of corona discharge electrodes spaced midway between said parallel rows of first negative electrodes and flow dividers and within said smaller gas streams for ionizing gas both before the gas enters the collection zones and after the gas enters the collection zones.

10. A system as recited in claim 9, wherein each plurality of collection zones, starts with a respective pair of impingement collection zones on the upstream side of each first negative electrode and of each flow divider followed by a pair of eddy zones on the downstream side of each first negative electrode and each flow divider, thereby producing four zones of collection per corona discharge electrode.

11. An improved method of creating flow resistance and balance at an inlet flow end of a flowing gas purifying electrostatic precipitator system having said inlet flow end and downstream therefrom a plurality of rows of laterally spaced plates transverse to the flow of gas, and in each row between said laterally spaced plates locating respective flow dividers for forming inlet flow apertures for improving gas distribution thereinto and stratification downstream therefrom, comprising the steps: (a) moving flow dividers at the inlet flow end to vary said inlet flow apertures; and (b) moving flow dividers spaced from said inlet flow apertures within rows of said plurality of rows and thereby creating flow resistance and breaking up stratification.

12. A method of producing desired flow resistance and balance in selected locations in a path of flowing gas in an electrostatic precipitator that is subject to rapping, and providing quiescent zones clear of the flowing gas for receiving collected particulate and minimizing particulate re-entrainment during said rapping, comprising the steps:

(a) interposing in the flowing gas a first row of collecting electrode plates having spaces between them and disposed transverse to the flowing gas, (b) diverting from selected locations the flowing gas by interposing a second row of collecting electrode plates downstream from the first row of collecting electrode plates and staggered laterally with respect thereto, thereby providing said quiescent zones; (c) interspersing a respective flow divider between collecting electrode plates in each said row and (d) repeating steps (a) (b) and (c) above.

13. A method as recited in claim 12, having the additional steps of: (e) moving all said flow dividers in a direction perpendicular to said rows and thereby changing said spaces, while (f) observing said flow resistance and balance to select locations for fastening said flow dividers, and (g) fastening all said flow dividers in said selected locations.

14. A system for balancing flow resistance in a gas-flow purifying electrostatic precipitator having a plurality of electrostatic elements having lateral spacings in a row transverse to said gas flow, characterized by: every alternate electrostatic element being a flow divider and having an adjustment means permitting moving all said flow dividers in a direction transverse to said row and changing said spacings, and a bellcrank mechanism for holding said flow dividers for movement together when moved.

* * * * *